US006092374A

United States Patent [19]

Kang et al.

[11] Patent Number: 6,092,374

[45] Date of Patent: Jul. 25, 2000

[54] REFRIGERATOR ICE-MAKER WATER SUPPLY APPARATUS AND METHOD THEREOF

[75] Inventors: Yun-Seog Kang; Jong-Hyun Lee, both of Suwon, Rep. of Korea

[73] Assignee: Samsung Electronics Co., Ltd., Suwon, Rep. of Korea

[21] Appl. No.: 08/987,470

[22] Filed: Dec. 9, 1997

[30] Foreign Application Priority Data

| | | | |
|---|---|---|---|
| Dec. 28, 1996 | [KR] | Rep. of Korea | 96-75635 |
| Dec. 28, 1996 | [KR] | Rep. of Korea | 96-75636 |
| Dec. 28, 1996 | [KR] | Rep. of Korea | 96-75637 |

[51] Int. Cl.[7] ..... F25C 1/12

[52] U.S. Cl. ..... 62/74; 62/233

[58] Field of Search ..... 62/74, 137, 233, 62/347

[56] References Cited

U.S. PATENT DOCUMENTS

| | | | |
|---|---|---|---|
| 3,396,552 | 8/1968 | Buchser | 62/233 |
| 3,779,032 | 12/1973 | Nichols | 62/233 |
| 4,573,325 | 3/1986 | Chiu et al. | 62/233 |
| 4,787,216 | 11/1988 | Chesnut et al. | 62/233 |
| 4,866,948 | 9/1989 | Cole | 62/233 |
| 4,872,317 | 10/1989 | Reed | 62/233 |
| 4,987,746 | 1/1991 | Roberts | 62/137 |

*Primary Examiner*—William E. Tapolcai
*Attorney, Agent, or Firm*—Burns, Doane, Swecker & Mathis, L.L.P.

[57] ABSTRACT

An ice maker of a refrigerator having an ice tray for supplying water and a water supply valve for supplying water to the ice tray, wherein a water supply control apparatus comprises: a water supply time unit for gradually controlling the water supply time to supply a predetermined amount of water during a preset water supply time; a control unit for controlling the predetermined amount of water to be supplied to the ice tray during the time set by the water supply time unit; and a display unit for showing a water supply time set by the water supply time unit according to the control unit, thereby accurately changing the water supply time and the amount of the water to be supplied to the ice tray.

9 Claims, 8 Drawing Sheets

FIG. 8

| | | | | | | | | | |
|---|---|---|---|---|---|---|---|---|---|
| WATER SUPPLY TIME OPTION | DIODE1 | 0 | 1 | 0 | 1 | 0 | 1 | 0 | 1 |
| | DIODE2 | 0 | 0 | 1 | 1 | 0 | 0 | 1 | 1 |
| | DIODE3 | 0 | 0 | 0 | 0 | 1 | 1 | 1 | 1 |
| WATER SUPPLY TIME DURATION(SEC) | | 6 | 7 | 8 | 9 | 10 | 11 | 12 | 13 |

*'0'MEANS PRESENCE OF DIODE
'1' MEANS ABSENCE OF DIODE

FIG. 9

| | | | | | | | | | |
|---|---|---|---|---|---|---|---|---|---|
| WATER SUPPLY TIME OPTION | SW1 | 0 | 1 | 0 | 1 | 0 | 1 | 0 | 1 |
| | SW2 | 0 | 0 | 1 | 1 | 0 | 0 | 1 | 1 |
| | SW3 | 0 | 0 | 0 | 0 | 1 | 1 | 1 | 1 |
| WATER SUPPLY TIME DURATION(SEC) | | 6 | 7 | 8 | 9 | 10 | 11 | 12 | 13 |

*'0'MEANS SWITCH OFF STATE
'1' MEANS SWITCH ON STATE

REFRIGERATOR ICE-MAKER WATER SUPPLY APPARATUS AND METHOD THEREOF

BACKGROUND OF THE INVENTION

1. Field of the Invention

The present invention relates to a refrigerator ice maker, and more particularly to an ice-maker water supply apparatus of a refrigerator and the method thereof to conveniently control the water quantity to be supplied to an ice tray.

2. Description of the Prior Art

In general, an ice maker directly connected to a faucet freezes the tap water with cold air into ice, and automatically separates and moves the ice formed at the ice tray to store at an ice storage container.

The ice maker, as shown in FIG. 1, comprises an ice tray (5) formed with a plurality of grooves and placed at a freezing chamber (2) divided from a refrigerating chamber (3) of a main body (1) for making ice of water supplied from a tap, and a solenoid valve (6: hereinafter referred to as a water supply valve) for being turned on/off to supply a predetermined quantity of water from a tap water pipe (4) to the ice tray (5).

A vaporizer (7) is installed at the lower right end to the ice tray (5) for heat exchanging the air blown in the freezing chamber (2) into cold air by way of the vaporized latent heat of a coolant, and a cooling fan (9) is disposed over the vaporizer (7) for being rotated by a fan motor (8) to circulate the heat exchanged cold air to make the water at the ice tray (5) into ice.

There are an ice storage container (10) under the ice tray (5) for storing the ice made by the cooling fan (9), an ice quantity detecting lever (11) movably hinged at a hinge point (12) for detecting the quantity of the ice stored at the ice storage container (10), and a micro-switch (13) installed at an end of the ice quantity detecting lever (11) for being vertically moved by the ice quantity detecting lever (11) according to the quantity stored at the ice storage container (10).

When power is applied, a micro-computer checks if an ice making condition is formed to carry out an ice making cycle at the ice maker. The ice making cycle is divided into 3 steps.

A first step of the ice making cycle is to initialize the refrigerator and to supply water to the ice tray (5), a second step is to freeze the water at the ice tray (5) into ice, and a third step is to separate and move the ice formed at the ice tray (5) to be stored at the ice storage container (10)

A conventional method to control the amount of water to be supplied to the ice tray (5) is manually set with a mechanical screw type of dial by controlling the time to supply water and with an electromagnetic type of diode options to change the time of supplying water according to a micro-computer program.

An after sales (A/S) service person checks the tap water pressure when a refrigerator is installed and manipulates a dial for setting a time to supply water at a timer, as disclosed in a water supply apparatus of the ice maker of a refrigerator in U.S. Pat. No. 4,987,746.

According to the aforementioned patent of the ice maker water supply control apparatus, if water needs to be supplied to the ice maker, water is automatically supplied by a pump through first and second electric methods during the water supply time preset at the timer, thereby achieving convenient water supply. However, there is a problem in the conventional water supply apparatus in that the water supply time is not properly set due to the problematic water pressure of the tap water source.

In addition, if the water supply time is controlled by setting the diode option, there is a problem in the electromagnetic type of the ice maker water supply control apparatus in that the diodes are to be inconveniently soldered, inserted and removed, if necessary, causing waste of time and reduction in reliability of the product.

SUMMARY OF THE INVENTION

The present invention is presented to solve the aforementioned problems and it is an object of the present invention to provide a water supply control apparatus of an ice maker of a refrigerator and the method thereof, wherein the apparatus sets a water supply time at a micro-computer program and then manually changes the time with a key disposed at an operation panel with options of DIP switches and diodes, thereby accurately changing the water supply time and properly controlling the amount of water to be supplied to an ice tray.

In order to achieve the aforementioned objects, it is provided an ice maker of a refrigerator having an ice tray for supplying water and a water supply valve for supplying water to the ice tray, wherein the water supply control apparatus of an ice maker comprises:

water supply time means for gradually controlling the water supply time to supply a predetermined amount of water during a water supply time;

control means for controlling a predetermined amount of water to be supplied to the ice tray during the water supply time set by the water supply time means; and display means for showing the water supply time set by the water supply time means according to the control means.

The ice maker water supply control method of the present invention comprises the steps of:

setting a basic value, the supply time of water to be supplied to the ice tray after power is applied;

controlling a water supply valve to supply the water to the ice tray during basic water supply time set at the basic time setting step;

changing the water supply time of the water supplied to the ice tray to display the time thereof; and resetting the water supply time changed at the water supply change display step.

DESCRIPTION OF THE DRAWINGS

For fuller understanding of the nature and objects of the invention, reference should be made to the following detailed description taken in conjunction with the accompanying drawings in which:

FIG. 8 is Table for setting water supply time in accordance with a first embodiment of the present invention;

FIG. 9 is Table for setting water supply time in accordance with a second embodiment of the present invention.

DETAILED DESCRIPTION OF THE INVENTION

Figure 1:
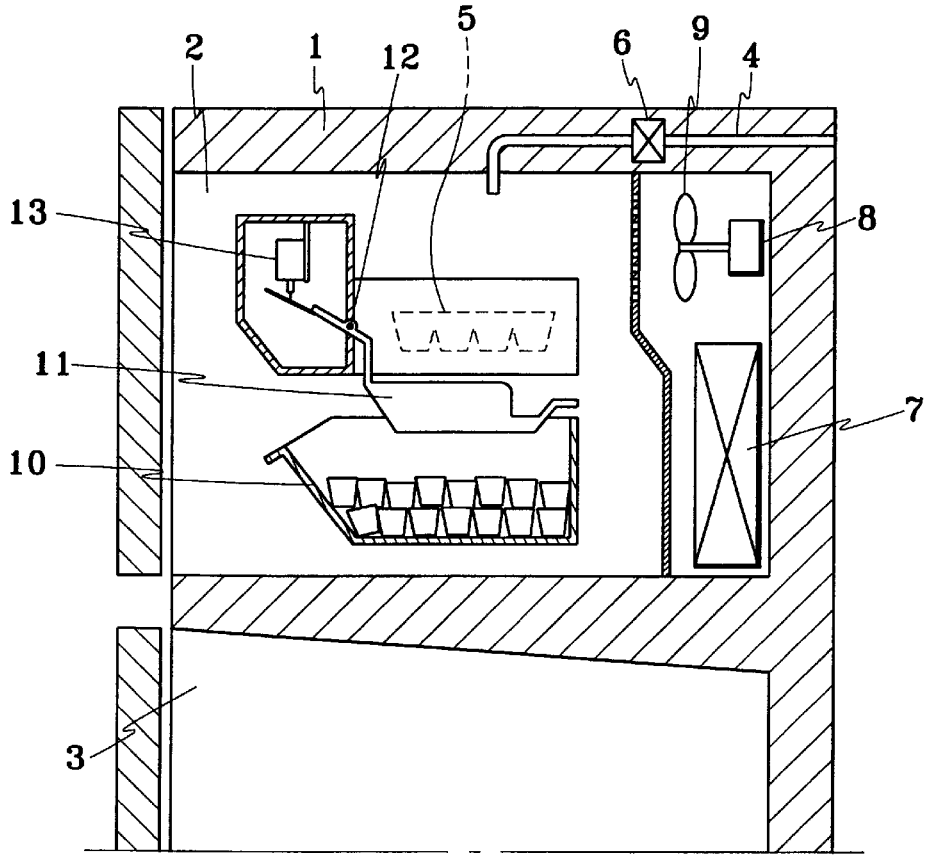
FIG. 1 (PRIOR ART)
FIG. 1 is a brief longitudinal view of a conventional ice maker of a refrigerator.
Figure 2:
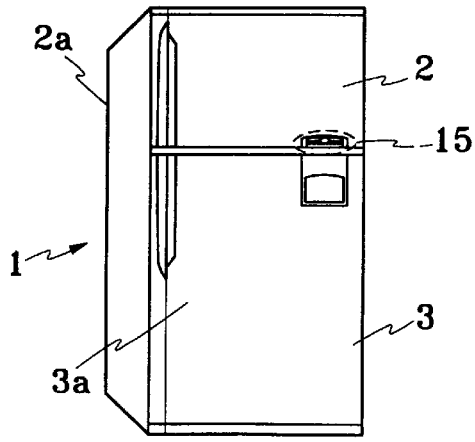
FIG. 2 is a perspective front view of a refrigerator in accordance with the present invention.
Figure 3:
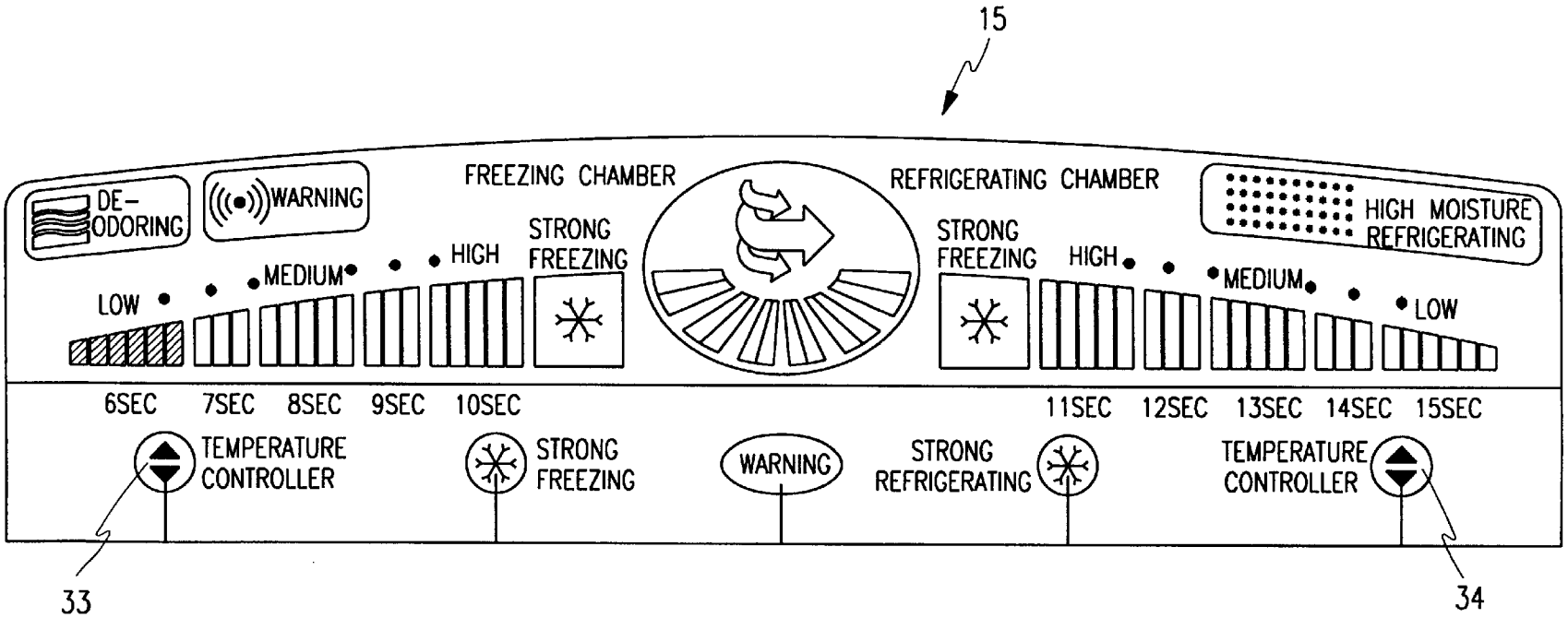
FIG. 3 is a view for showing a front panel of a refrigerator in accordance with a first embodiment of the present invention.

A preferred embodiment of the present invention is described in detail with accompanying drawings. As shown in FIG. 2, a refrigerator is provided with a freezing chamber (2) and a refrigerating chamber (3) for storing food divided into upper and lower portions of a main body (1), doors (2*a* and 3*a*) installed for opening and closing the chambers (2 and 3) and an operation panel (15) disposed at a lower end of the freezing chamber door (2*a*) for selecting a variety of operational functions, setting a chamber temperature and for showing the selected operational functions and the chamber temperature.

Figure 5:
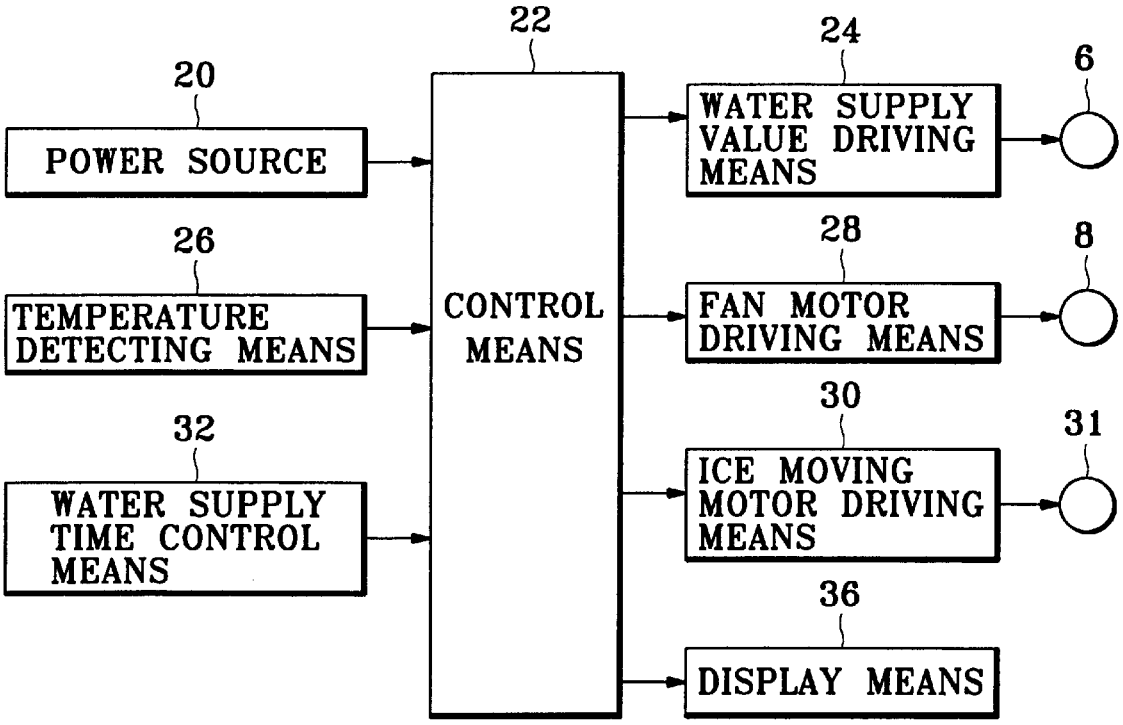
FIG. 5 is a block diagram for illustrating the control of a water supply control apparatus in accordance with a first embodiment of the present invention.
Figure 6:
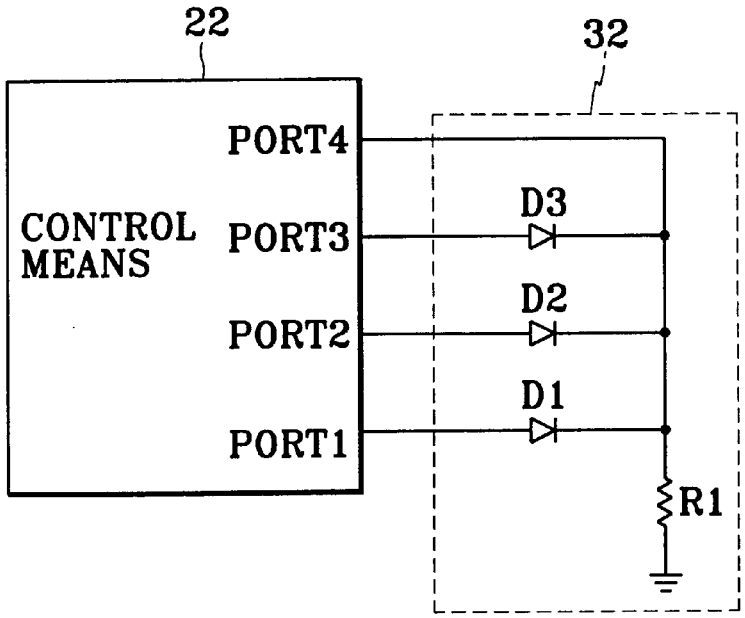
FIG. 6 is a block diagram for a circuit of a water supply control apparatus in accordance with a first embodiment of the present invention.
Figure 7:
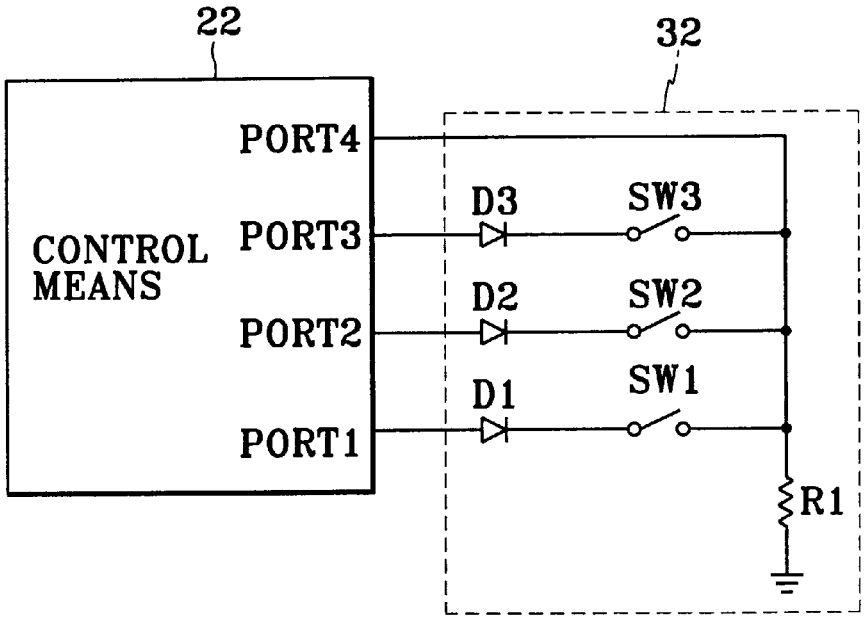
FIG. 7 is a block diagram for a circuit of a water supply control apparatus in accordance with a second embodiment of the present invention.

Circuit block diagrams for controlling supply of water to an ice tray during a water supply time are described with reference to FIGS. 5 and 6. As shown in FIGS. 5 through 7, a power source (20) receives commercial alternating current voltage from an alternating current power terminal (not shown) and changes into the predetermined direct current voltage (power loaded for driving, micro-computer driving power) necessary for operating an ice maker.

The control means (22) is a micro-computer for receiving a direct current power (micro-computer driving power) to initialize an operation of an ice maker and to control the ice making operation according to the on/off signal of the micro-switch (13). The control means (22) controls a water supply valve (6) to supply the predetermined amount of water to an ice tray (5) during the water supply time set by the water supply control means.

The water supply valve driving means (24) controls a water supply valve (6) to supply water from the tap water pipe (4) to the ice tray (5) according to a control signal sent from the control means (22). The temperature detecting means (26) is a temperature sensor to detect the temperature of the water supplied at the ice tray (5) as the water supply valve (6) is open.

The fan motor driving means (28) controls a fan motor (8) for making the water at the ice tray (5) into ice according to a control signal sent from the control means (22). The ice moving motor driving means (30) controls an ice moving motor (31) for receiving the control signal output from the control means (22) and for separating and moving the ice formed at the ice tray for further storage.

In addition, the water supply time control means (32) manually changes the time to supply the predetermined amount of water to the ice tray (5) from tap pipe (4) by using freezing and refrigerating chamber keys (33 and 34), diodes (D1, D2 and D3), DIP switches (SW1, SW2 and SW3) and resistance (R1).

The display means (36) shows each temperature of freezing and refrigerating chambers at a display panel on the operation panel (15) and the water supply time manually changed with freezing and refrigerating keys (33 and 34).

Figure 10A:
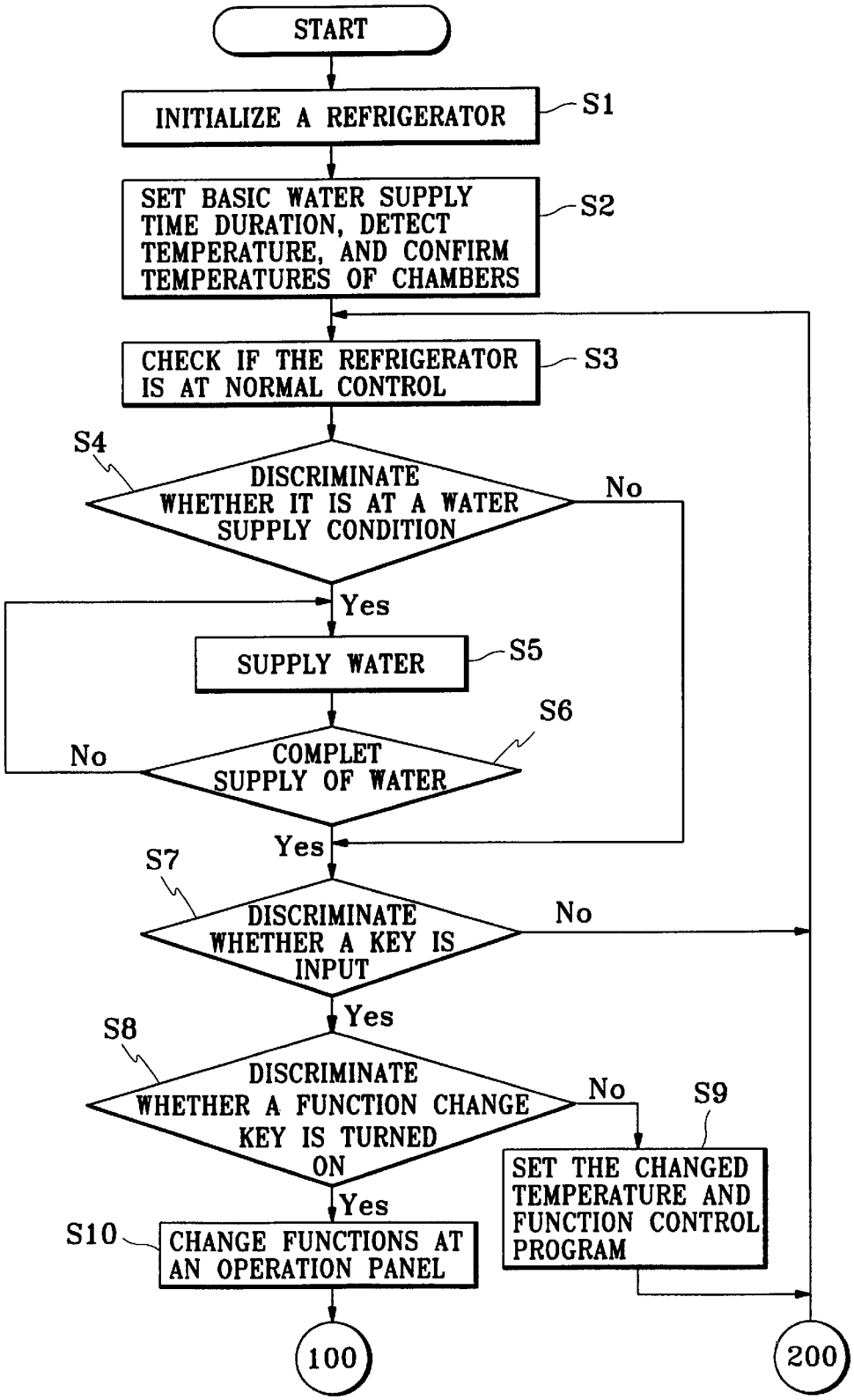
FIGS. 10A and 10B are flowcharts for illustrating an operational sequence to control water supply time in accordance with the present invention.
Figure 10B:
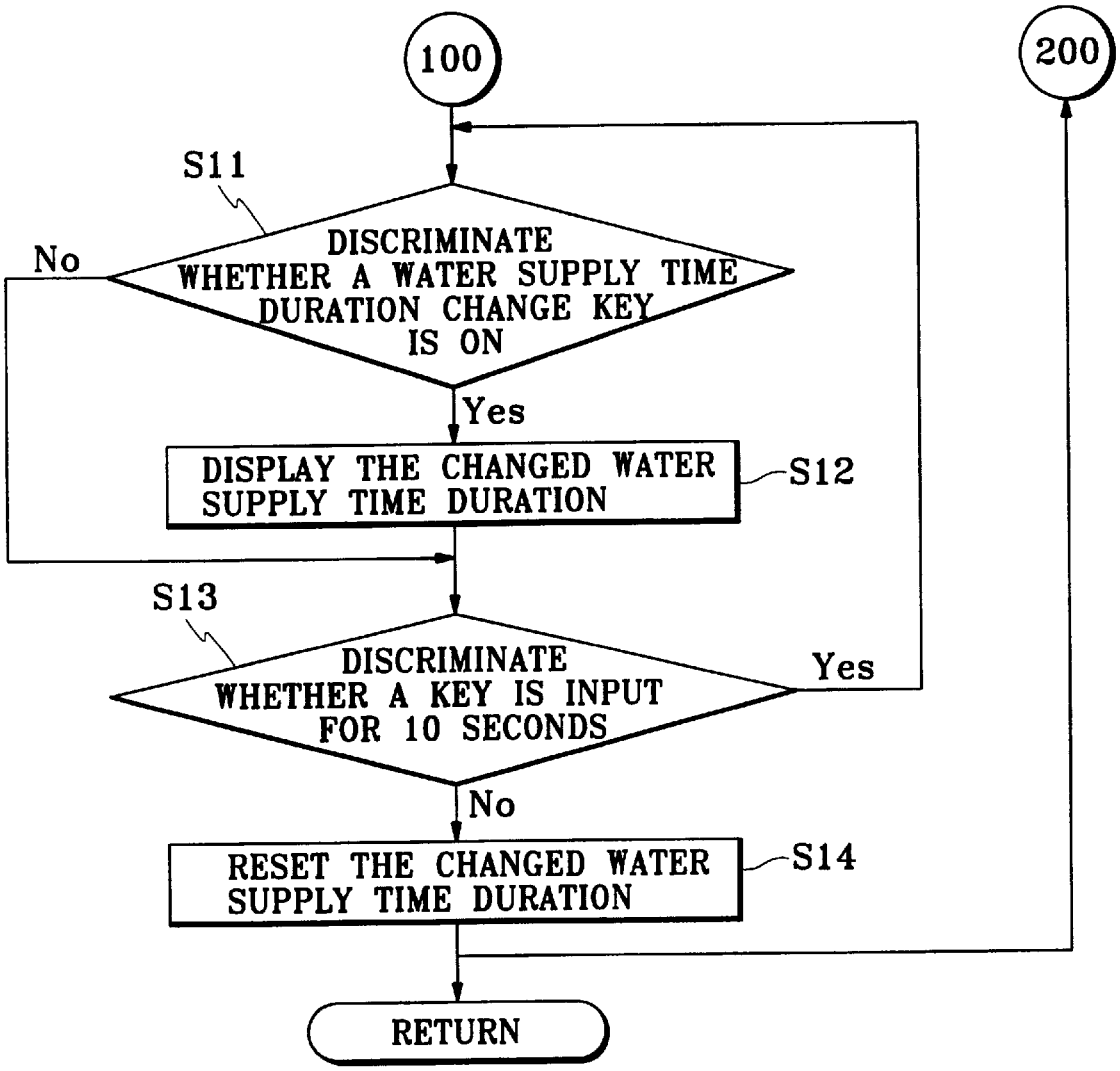

Next, the operational effect of the ice maker water supply control apparatus and the method thereof is described. FIGS. 10A and 10B are the flowcharts for illustrating the operational sequences of the ice maker water supply control apparatus, wherein S indicates each step.

At first, if power is applied, the power means (20) receives commercial alternating current voltage from the alternating current terminal (not shown), changes into power to drive the micro-computer, DC 5 V, and the load driving power, DC 12 V, necessary to drive the ice maker, and outputs them.

Therefore, step S1 is to input the direct current voltage output from the power means (20) to the control means (22) to initialize a refrigerator. At step S2, the control means (22) sets a basic water supply time (for instance, 6 seconds), the temperature detecting means (26) detects the temperature of water supplied to the ice tray (5), and it is discriminated whether temperatures of the freezing and refrigerating chambers are manually set with respective keys (33 and 34) at the operation panel (15).

At step S3, a normal control of each part of the refrigerator is carried out according to a programmed sequence. When ice is formed, the ice tray (5) is rotated at 180° to drop down ice to store at the ice storage container (10). At step S4, it is discriminated whether a condition is formed for additionally supplying water to the ice tray (5).

As a result of the discrimination at step S4, if the condition to supply water is made, the flow proceeds to step S5 where the control means (22) outputs a control signal to the water supply valve driving means (24) to turn on the water supply valve (6) and to supply water to the ice tray (5) during the basic water supply time of 6 seconds as preset, whereby water is supplied from the tap water pipe(4) during the basic water supply time.

At step S6, it is discriminated whether the water supply valve is open and the supply of water to the ice tray (5) is completed by detecting the water temperature with the temperature detecting means (26). If to supply water is not completed (in case of NO), the flow returns to step S5 and the repeated operations subsequent to step S5 are performed.

As a result of the discrimination at step S6, if water supply is completed (in case of YES), the water supply valve driving means (24) turns off the water supply valve (6) to stop supplying water. Then, the flow advances to step S7 where it is discriminated whether a key at the operation panel (15) is selected. If the key is not selected (in case of NO), the flow returns to step S3 and the repeated operations subsequent to step S3 are performed, simultaneously carrying out normal control of each part of the refrigerator as programmed.

As a result of step S7, if the key is selected (in case of YES), the flow proceeds to step S8 where it is discriminated whether a function switch key is selected and turned on at the operation panel (15) for changing the water supply time control mode of the ice maker. If the function switch key is not turned on, the flow proceeds to step S9 where a changed temperature and a function control program are set. In addition, the flow returns to step S3 and the repeated operations subsequent to step S3 are performed.

The function switch key is a key for changing a display status of the operation panel (15) to thereby switch function of the ice maker, when the freezing chamber key (33) and the refrigerating chamber key (34) are simultaneously pressed for 5 seconds, where a basic water supply time is 6 seconds when a light emitting diode LED only flickers at 'weak' position in the refrigerating chamber (3).

As a result of the discrimination at step S8, if the function switch key is turned on (in case of YES), the display state at operation panel (15) is to be changed into the water supply time control mode. AT step S1, it is discriminated whether the water supply time change key is input for changing the water supply time by pressing the refrigerating chamber key (34) as many times as the number of the time is desired.

Figure 4:
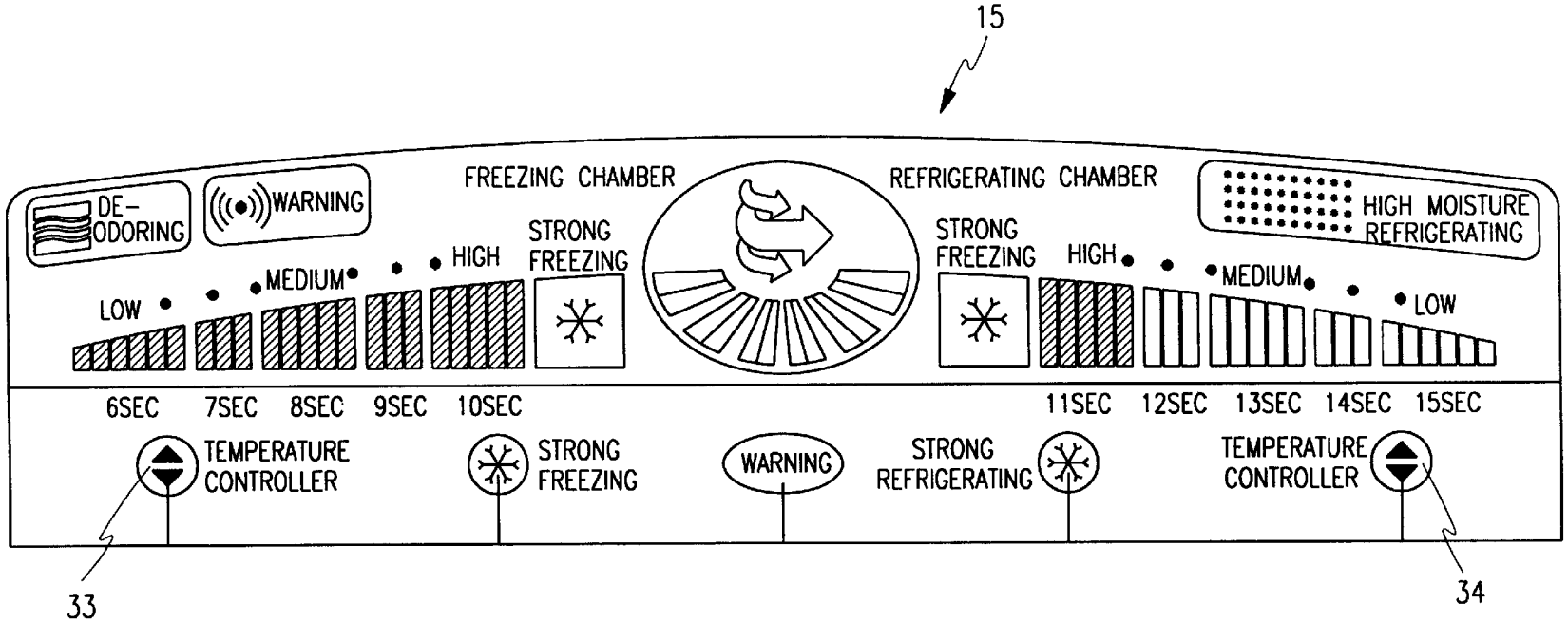
FIG. 4 is a view for showing a front panel of a refrigerator in accordance with a second embodiment of the present invention.

As a result of the discrimination at step S11, if the water supply time change key is input, (in case of YES), the flow proceeds to step S12 where it is discriminated whether the change of the water supply time is displayed depending on the number the refrigerating key (34) is being pressed. If the refrigerating chamber key (34) is additionally pressed five times, as shown in FIG. 4, the LED from 'weak' to 'strong' is lighted on, whereby it is known that the water supply time is changed into 11 seconds.

At step S13, after the water supply time is changed as desired, it is discriminated for 10 seconds whether a key is input. If the key is input (in case of YES), the flow returns to step S11 and the repeated operations subsequent to step S11 are performed. If the key is not input (in case of NO), the flow advances to step S14 where the water supply time is reprogrammed. The water supply time is changed to control the amount of water to be supplied (for instance, 11 seconds). In addition, the flow returns to step S3 and the repeated operations subsequent to step S3 are performed, returning functions of the operation panel (15) to its normal control state.

As a result of the discrimination at step S11, if the water supply time change key is not input (in case of NO), the flow proceeds to step S13 and repeated operations subsequent to step S13 are performed.

According to a first embodiment of the present invention, the quantitative water supply control manually with the freezing and refrigerating keys (33 and 34) influences not the normal control functions of the refrigerator but the water supply time of the ice maker. Therefore, the changed water supply time is to be removed if power is shut down. The water supply time is controlled in comparing with the basic water supply time when the power is re-applied.

Besides the method to change the water supply time with a manual operation of freezing and refrigerating keys (33 and 34), pressing as many times as the number of the water supply time is desired, there is provided another method to control the water supply time, as shown in FIGS. 6 and 7, with water supply time control means (32).

First of all, the method to control the water supply time with the water supply time control means (32) is described in detail with accompanying drawings of FIGS. 6 through 8.

A programmed water supply time is preset at a predetermined interval (for instance, 6, 7, 8 . . . 13 seconds) and the information of the diodes (D1, D2 and D3) of the water supply time control means (32) is used, whereby the control means (22) determines the water supply time (the amount of the water to be supplied).

If the diodes (D1 and D2) are inserted, the control means (22) outputs signals (high signals of 5 V) through the output terminals (PORT1, PORT2 and PORT3) to the diodes (D1, D2 and D3) at a predetermined time interval. The signals (H, H, and L) are sequentially input to an input terminal (PORT4), as shown in FIG. 8. The water supply time is discriminated as '9 seconds' as shown in Table preset for supplying water to the ice tray (5).

Next, a programmed water supply time is preset at a predetermined time interval (for instance, 6, 7, 8 . . . 13 seconds) and the information of the dual in-line package (DIP) switches (SW1, SW2 and SW3) of the water supply time control means (32) is used, whereby the control means (22) discriminates the water supply time (the amount of the water to be supplied).

If the DIP switches (SW1 and SW2) are turned on, the control means (22) outputs signals at a predetermined interval through the output terminals (PORT1, PORT2 and PORT3) to the diodes (D1, D2 and D3). The signals (H,H, and L) are sequentially input to an input terminal (PORT4), as shown in FIG. 9. The water supply time is determined as '9 seconds' as shown in Table preset for supplying water to the ice tray (5).

Therefore, in order to control the amount of the water to be supplied, the on/off state of the DIP switches (SW1, SW2 and SW3) and the insertion of the diodes (D1, D2 and D3) are changed with reference to Tables of the water supply time in FIG. 8 or 9, thereby easily controlling the water supply time and the amount of water to be supplied.

As described above, there is an advantage in the ice maker water supply control apparatus and the method thereof according to the present invention in that the water supply time is programmed at the micro-computer, manually and gradually changed with keys to control the temperature of the freezing and refrigerating chambers as preset in Tables and made DIP switches (SW1, SW2 and SW3) and diodes (D1, D2 and D3) optional to control the water supply time, thereby accurately changing the water supply time and the amount of water to be supplied to the ice tray.

What is claimed is:

1. An ice maker water supply control apparatus of a refrigerator having an ice tray and a water supply valve for supplying water to the ice tray, wherein the water supply control apparatus comprises:

water supply time setting means for setting a time period for supplying a predetermined amount of water to the ice tray;

control means including a micro computer connected to the water supply valve and the water supply time setting means for controlling the water supply valve on the basis of the water supply time period set by the water supply time setting means, to supply the predetermined amount of water to the ice tray;

display means for displaying the water supply time period set by the water supply time setting means under the control of the control means; and wherein the water supply time setting means comprises a plurality of water supply setting keys externally disposed at an operation panel of the refrigerator.

2. The apparatus, as defined in claim 1, wherein the water supply setting keys include a function switch key and a water supply time change key externally disclosed at the operation panel.

3. The apparatus, as defined in claim 1, wherein the water supply setting keys include a freezing chamber temperature control key and a refrigerating chamber temperature control key, wherein a water supply time setting mode is started by simultaneously pressing the freezing chamber temperature control key and the refrigerating chamber temperature control key, and a water supply time is changed by manipulating one of the freezing chamber temperature control key and the refrigerating chamber temperature control key.

4. The apparatus, as defined in claim 3, wherein the display means is disposed on the operation panel for displaying temperatures of a freezing chamber and a refrigerating chamber set respectively by the freezing chamber temperature control key and the refrigerating chamber temperature control key in a normal operation mode, which is separate from a water supply time setting mode.

5. An ice maker water supply control method for a refrigerator having an ice tray, a water supply valve for supplying water to the ice tray, and a micro computer for controlling the valve, wherein the water supply control method comprises the steps of:

A) setting a water supply time period as a given basic value after power is applied;

B) controlling the water supply valve by the micro computer to supply water to the ice tray for the water supply time period corresponding to the basic value set in step A;

C) changing the water supply time period by manipulating at least one of a function switch key and a water supply time change key disposed at an operation panel of the refrigerator;

D) displaying the water supply time period being changed under the control of the micro computer during the changing step; and E) resetting the basic value as the water supply time period changed in step C.

6. The method, as defined in claim 5, wherein the keys include a freezing chamber temperature control key and a refrigerating chamber temperature control key, wherein a water supply time setting mode is started by simultaneously pressing the freezing chamber temperature control key and the refrigerating chamber temperature control key, and a water supply time is changed by manipulating one of the freezing chamber temperature control key and the refrigerating chamber temperature control key.

7. The method, as defined in claim 6, wherein step D includes displaying temperatures of a freezing chamber and a refrigerating chamber set by the freezing chamber temperature control key and the refrigerating chamber temperature control key, respectively, in a normal operation mode which is separate from a water supply time setting mode.

8. An ice maker water supply control apparatus of a refrigerator having an ice tray and a water supply valve for supplying water to the ice tray, wherein the water supply control apparatus comprises:

water supply time setting means for setting a time period for supplying a predetermined amount of water to the ice tray;

control means including a micro computer connected to the water supply valve and the water supply time setting means for controlling the water supply valve on the basis of the water supply time period set by the water supply time setting means, to supply the predetermined amount of water to the ice tray;

display means for displaying the water supply time period set by the water supply time setting means under the control of the control means; and wherein the water supply time setting means comprises a set of DIP switches connected in parallel with the control means, to enable a manipulation of the DIP switches to input to the control means information relating to the water supply time.

9. An ice maker water supply control apparatus of a refrigerator having an ice tray and a water supply valve for supplying water to the ice tray, wherein the water supply control apparatus comprises:

water supply time setting means for setting a time period for supplying a predetermined amount of water to the ice tray;

control means including a micro computer connected to the water supply valve and the water supply time setting means for controlling the water supply valve on the basis of the water supply time period set by the water supply time setting means, to supply the predetermined amount of water to the ice tray;

display means for displaying the water supply time period set by the water supply time setting means under the control of the control means; and wherein the water supply time setting means comprises a set of diodes connected in parallel with the control means, to enable a manipulation of the diodes to input to the control means information relating to the water supply time.

* * * * *